United States Patent [19]

Quinn et al.

[11] Patent Number: 4,807,317

[45] Date of Patent: Feb. 28, 1989

[54] MODULAR RAMP

[75] Inventors: Charles F. Quinn, Grand Rapids; Thomas E. Young, East Lansing, both of Mich.

[73] Assignee: Easter Seal Society of Michigan, Inc., Grand Rapids, Mich.

[21] Appl. No.: 66,042

[22] Filed: Jun. 24, 1987

[51] Int. Cl.[4] ..... E01C 1/00

[52] U.S. Cl. ..... 14/69.5; 404/35; 404/43

[58] Field of Search ..... 14/1, 69.5; 404/35, 404/36, 43, 41; 182/113, 222; 52/487, 761

[56] References Cited

U.S. PATENT DOCUMENTS

| | | | |
|---|---|---|---|
| 743,964 | 11/1903 | Weir | 403/235 |
| 952,239 | 3/1910 | Davidson | 182/48 |
| 1,974,080 | 9/1934 | Marker et al. | 52/38 |
| 2,044,260 | 6/1936 | Schiele | 52/184 |
| 2,249,941 | 7/1941 | Burton | 182/113 X |
| 2,656,224 | 10/1953 | Gray | 14/69.5 X |
| 2,851,311 | 9/1958 | Gibbs | 14/1 X |
| 3,074,239 | 1/1963 | Mustard | 14/1 X |
| 3,628,628 | 12/1971 | Gilbreath et al. | 182/222 |
| 3,936,898 | 2/1976 | Poe | 14/69.5 |
| 4,050,257 | 9/1977 | Parks et al. | 182/222 X |
| 4,376,596 | 3/1983 | Green | 404/35 |
| 4,468,901 | 9/1984 | Henderson et al. | 52/184 |
| 4,569,500 | 2/1986 | Beede | 182/179 |
| 4,577,449 | 3/1986 | Celli | 52/174 |
| 4,630,709 | 12/1986 | Taylor | 14/69.5 |
| 4,648,484 | 3/1987 | Lovering | 182/222 |

*Primary Examiner*—Jerome W. Massie, IV
*Assistant Examiner*—Matthew Smith
*Attorney, Agent, or Firm*—Warner, Norcross & Judd

[57] ABSTRACT

The specification discloses a modular and reusable wheelchair ramp capable of ready assembly and disassembly while providing a strong and safe construction. The ramp includes a plurality of leg assemblies fabricated of PVC plumbing components and a plurality of ramp sections each extending between and mounted on a pair of adjacent leg assemblies. Each leg assembly includes a pair of legs and an interconnecting crossbar slidably received thereon for ready height adjustability. The ramp sections are hooked over the crossbars. In a preferred embodiment, handrails also fabricated of PVC plumbing components are also slidably mounted on the legs.

24 Claims, 4 Drawing Sheets

FIG. 1
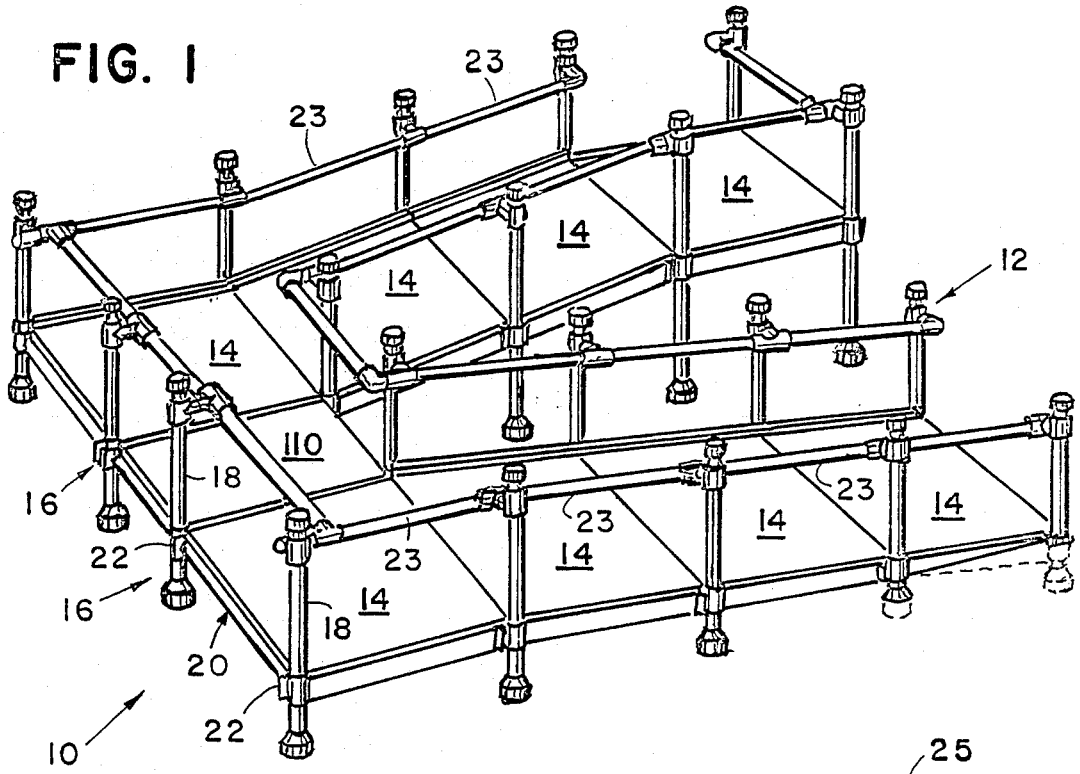
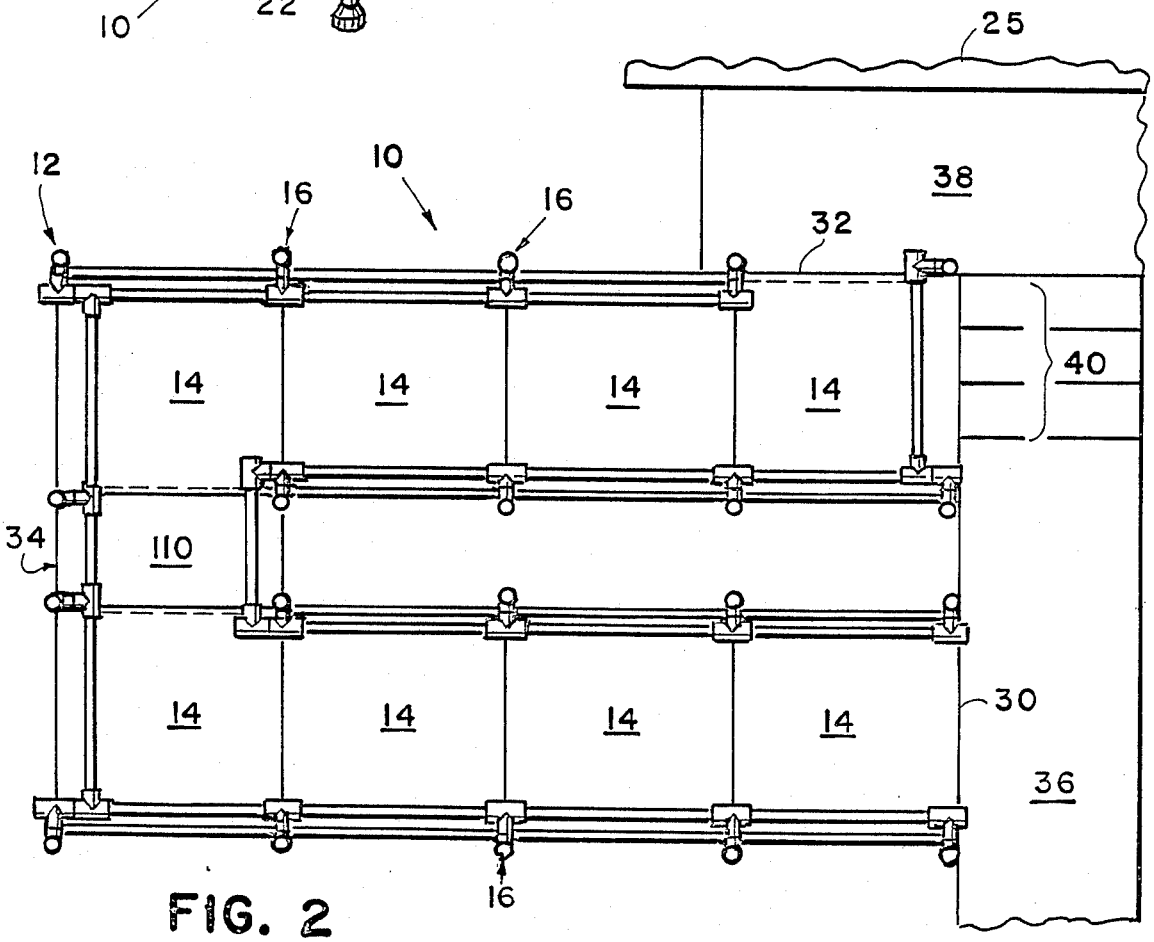
FIG. 2

46
16
48
52
66
64
70
66
48
42
18
60
56
52
66
54
64
66
62
48
114
122
112
116
122
110
118
120

112
110
122
116
122
120
120
118
118
112
118
114
120
120
116
122
64
54"
74
76
44
50

82
81
83
86
90
92
88
108
106
106
94
91
92
91
90
84
100
102
88
104
86

82
IX
83
88

84
100
102
104
IX 84
86
84
82
88
14
88
88
83
80
83
84
86
84

92
81
82
90
91
86
84
88

MODULAR RAMP

BACKGROUND OF THE INVENTION

The present invention relates to a building-access ramp for physically handicapped individuals, and more particularly to such a ramp which is modular in construction and capable of ready assembly and disassembly.

The relatively simple function of entering a building can be extremely difficult for physically handicapped, infirm, and/or aged individuals. Climbing steps is a function which is simply impossible for individuals confined to wheelchairs or even using walkers. Although building codes require new commercial buildings to be "handicap-accessible", residential construction codes to not include such requirements; and many older commercial buildings remain handicap inaccessible.

When an individual desires to provide a handicap access to his home or an existing commercial building, most typically a wooden ramp is erected. Generally speaking, each ramp is unique in design and is permanently attached to the building structure. Construction often results in a relatively large amount of scrap lumber. The cost of constructing a ramp in this fashion is high, requiring a relatively large amount of carpenter time. The ramp is typically torn down when no longer required; and the lumber is generally non-reusable.

SUMMARY OF THE INVENTION

The aforementioned problems are overcome in the present invention comprising a modular wheelchair ramp capable of ready assembly and disassembly. The ramp includes a supporting frame fabricated substantially exclusively of inexpensive conventional PVC plumbing components and a plurality of wooden ramp sections mounted on the frame. The frame includes a plurality of support or leg assemblies each including a pair of legs and a horizontal crossbar slidably mounted thereon for height adjustability. The leg assemblies are arranged along a ramp path; and the crossbars are adjusted to define an inclined support structure. The wooden ramp sections are installed on the crossbars to complete assembly.

The present ramp construction is relatively inexpensive, being fabricated of conventional PVC plumbing parts and wooden ramp sections. Further, the ramp kit can be easily assembled by a single individual, reducing installation cost. Ramp assembly does not result in scrap material since all ramp components are self-contained and put together in "erector set" fashion. Finally, the ramp can also be readily disassembled for movement to a different location.

These and other objects, advantages, and features of the invention will be more readily understood and appreciated by reference to the detailed description of the preferred embodiment and the drawings.

BRIEF DESCRIPTION OF THE DRAWINGS

FIG. 1 is a perspective view of the modular ramp of the present invention;

FIG. 2 is a top plan view of the ramp;

DETAILED DESCRIPTION OF THE PREFERRED EMBODIMENT

Figure 3:
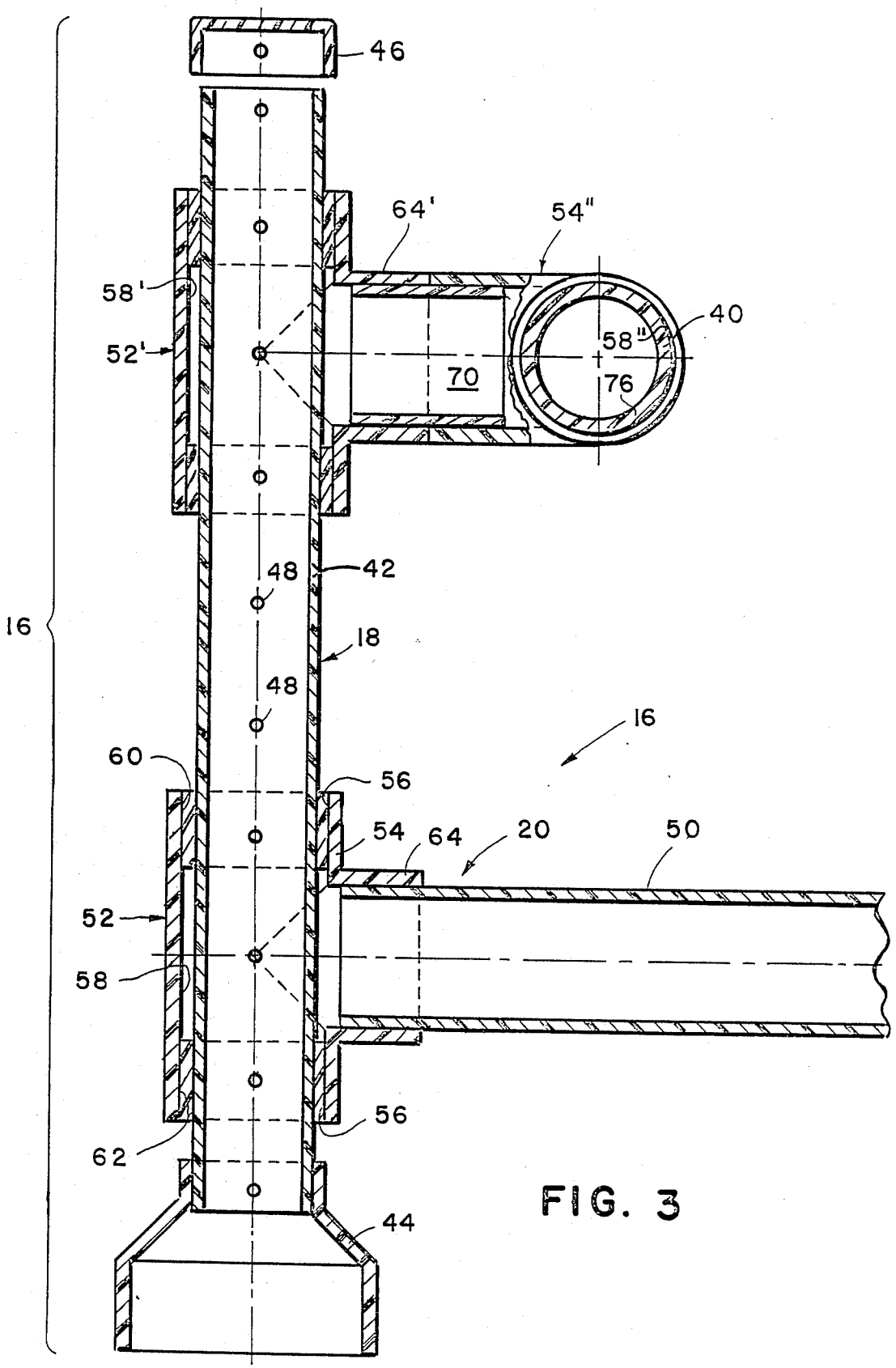
FIG. 3 is a fragmentary sectional view through a leg assembly.

A modular wheelchair ramp constructed in accordance with a preferred aspect of the invention is illustrated in FIGS. 1 and 2 and generally designated 10. Basically, the ramp includes a supporting frame assembly 12 and a plurality of ramp sections 14 removably supported thereon. The frame 12 in turn includes a plurality of leg assemblies 16 arranged to define a ramp path. Each leg assembly 16 includes a pair of upright members or leg 18 and a crossbar 20 slidably mounted thereon. The ramp sections 14 each include brackets 22 which fit over the crossbar 20 to support the ramp sections on the frame. A plurality of handrail segments 23 are mounted between legs 18 of adjacent leg assemblies 16 to provide a continuous handrail.

As illustrated in FIG. 2, the ramp 10 is typically installed to provide access to a residential dwelling or other building 25. The ramp is erected in modular fashion beginning at the high end 32 by erecting two leg assemblies and mounting a ramp 14 thereon. Thereafter, a leg assembly and additional ramp section are sequentially installed to provide the ramp path. The height of each crossbar 20 on each leg assembly 16 is adjusted to provide a generally uniform slope throughout the length of the ramp. The ramp includes a low end 30, a high end 32, and a turn or transition point 34 midway therealong. The low end 30 leads off a concrete walk 36; and the high end 32 exits onto a porch 38. By using the ramp, one may easily bypass the stairs 40 leading from the walk 36 to the porch 38.

Figures 4, 10, 11:
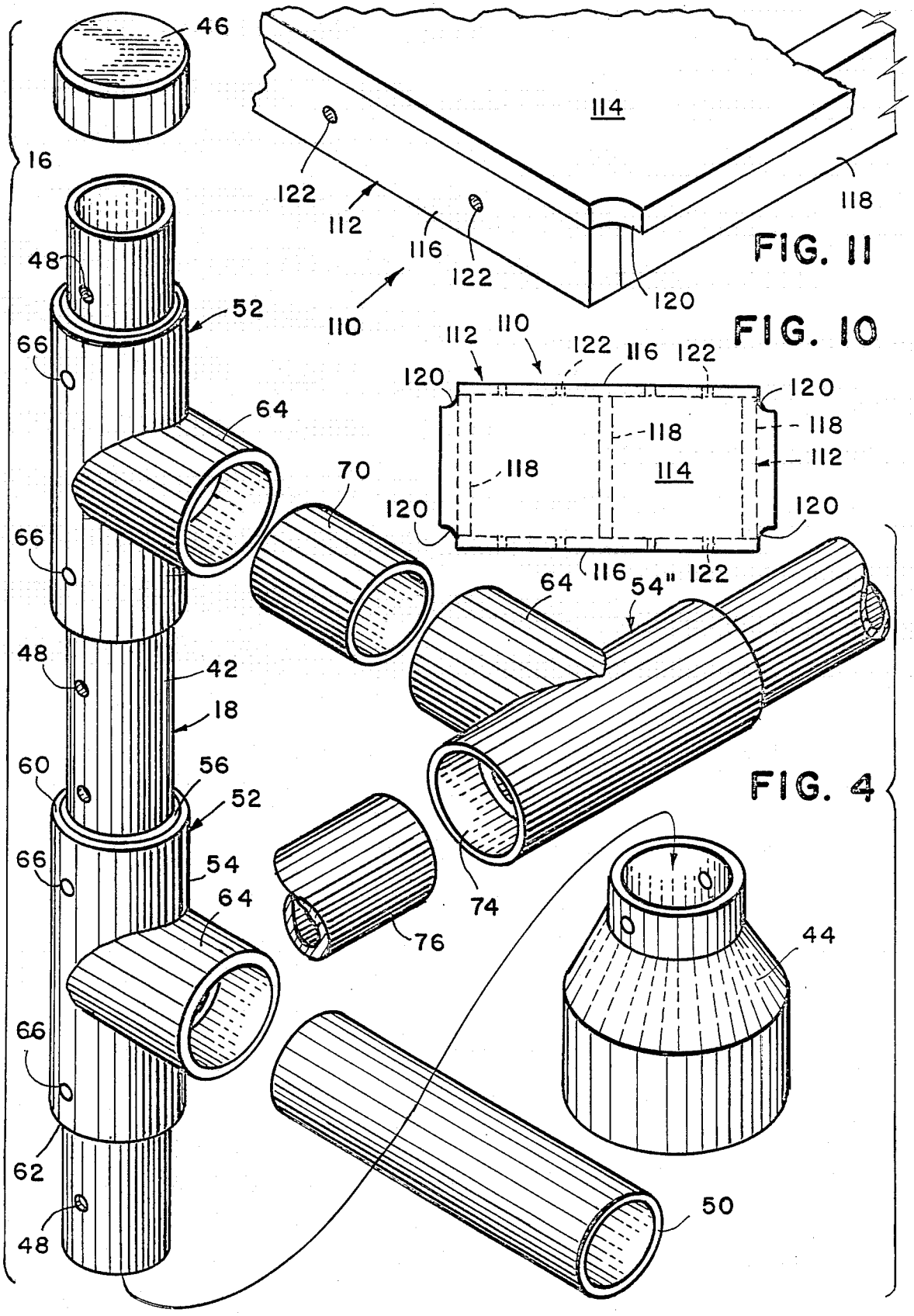
FIG. 4 is a fragmentary, perspective, exploded view of the leg assembly illustrated in FIG. 3.
FIG. 10 is a top plan view of the connector unit.
FIG. 11 is a fragmentary perspective view of one corner of the connector unit.

The construction of the support assemblies 16 is illustrated in FIGS. 3 and 4. Generally speaking, the leg assembly 16 includes a pair of vertical upright members or legs 18 (only oe of which is shown in FIGS. 3 and 4), a horizontal support member or crossbar 20 extending therebetween, and a handrail 40. All of the components of the support assemblies 16 are fabricated substantially exclusively of PVC plumbing components.

The leg 18 (FIGS. 3 and 4) includes a body 42, a foot 44, and a cap 46. In the preferred embodiment, the leg body 42 is 1½-inch PVC pipe. A plurality of apertures 48 each having a diameter of 5/16 inch are drilled on 2-inch centers along the height of the leg body 42 to provide an interlock mechanism as will be described. The foot 44 is a PVC bell reducer of the size 3 inch to 1½ inch and is secured to the lower end of the leg body 42 using a suitable conventional plumbing adhesive. The cap 46 is removably mounted on the upper end of the leg body 42 to provide a neatly finished aesthetic appearance and to prevent articles from being deposited or otherwise accumulating within the leg 18.

The crossbar 20 (FIGS. 3 and 4) includes a crossbar body 50 and a T-slide 52. In the preferred embodiment, the crossbar body 50 is a 2-inch PVC pipe. The T-slide 52 in turn includes a 2-inch PVC slip T 54 and a pair of reducer sleeves 56 (with the stops removed) mounted therein. The slip T 54 defines a cylindrical throughbore 58 having an upper end 60 and a lower end 62. One reducer sleeve 56 is fixedly secured within each of the upper and lower ends 60 and 62 to reduce the diameter of the T-slide 52 in these areas from 2 inches to 1½ inches. The slip T 54 further includes an annular collar 64 extending perpendicularly from the throughbore 58. The crossbar body 50 is fixedly secured within the collar 64 using a suitable conventional plumbing adhesive.

The T-slide 52 is freely slidable along the leg body 42 so that the crossbar 20 can be elevated or lowered to any desired height. The T-slide 52 includes a pair of apertures 66 (see FIG. 4) which can be aligned with the apertures 48 in the leg body 42. Therefore, the slip T 52 and leg 18 can be interlocked at any desired height by inserting ¼-inch bolts (not shown) or other elongated fasteners through the aligned apertures 48 and 66.

The handrail segments 23 (FIGS. 1–4) are mounted on the vertical legs 18 in a manner similar to that of the crossbars 20. The resultant handrail is preferably 30 to 34 inches above the ramp surface. Specifically, the handrail segments 23 each includes a T-slide 52' identical to that described above. However, a stub pipe 70 is secured within the annular collar 64' instead of the crossbar body. Also supported on the stub pipe 70 is the annular collar 64'' of yet another slip T 54''. The throughbore 58'' of the second slip T 54'' is oriented generally perpendicularly to the throughbore 58' of the T-slide 52'. The handrail body 76 is supported within the throughbore 74, so that the handrail body 76 is oriented generally perpendicularly to the crossbar bodies 50.

Figures 5, 6, 7, 8, 9:
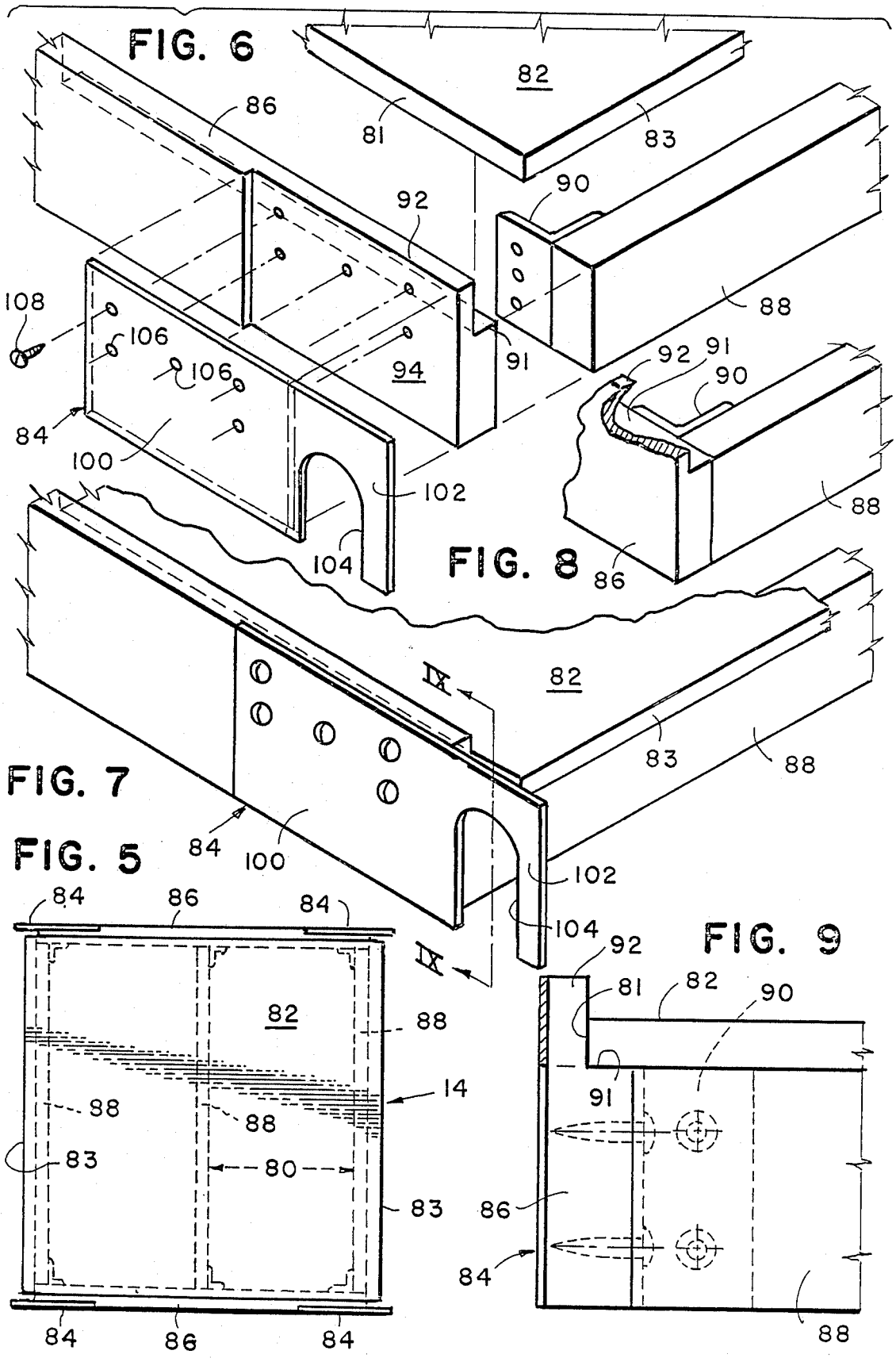
FIG. 5 is a top plan view of a ramp section.
FIG. 6 is a fragmentary, exploded, perspective view of one corner of the ramp section.
FIG. 7 is a fragmentary perspective assembled view of the corner of the ramp section.
FIG. 8 is a fragmentary perspective view of the ramp corner with the support bracket removed.
FIG. 9 is a sectional view taken along plane IX—IX in FIG. 7.

The construction of the ramp sections 14 is illustrated in FIGS. 5–9. Each section includes a frame 80, a ramp surface 82, and four support brackets 84. The frame 80 includes a pair of side rails or stringers 86 and three crossbraces 88 extending therebetween. The crossbraces 88 are secured at both of their opposite ends to the stringers 86 using angle brackets 90 and screws (not shown) in conventional fashion. The stringers 86 and crossbraces 88 are both fabricated of Wolmanized (trademark) two-by-fours. The inner upper corner when viewed in cross section of the stringers 86 is routed to form a ledge 91 and a lip 92 extending upwardly from one side thereof a height of 1½ inches. As seen in FIGS. 8 and 9, the upper edges of the crossbraces 88 are level with the ledge 91 to define a support plane for the ramp surface 82. The outer side of the stringer 86 is also removed adjacent the end of both stringers to form a recessed face 94 to receive the support bracket 84 as will be described.

The ramp surface 82 is generally planar and in the preferred embodiment is Wolmanized (trademark) ¾-inch plywood four-feet-by-four-feet square. The ramp surface 82 is secured to the frame 80 using nails or other conventional fasteners. At its lateral edges 81, the ramp surface 82 fits within the lips 92 and rests on the ledge 91. Since lip 92 extends 1½ inches up from ledge 91, the lip extends approximately ¾-inch above the the ramp body 82 to reduce the possibility that an object, such as a wheelchair wheel, will fall off the edge of the ramp. At its end edges 83, the ramp surface 82 extends beyond the crossbrace 88 a distance of 1½ inches to accommodate the crossbar 20 on the leg assembly 16.

The support bracket 84 (FIGS. 5–7 and 9) is fabricated of steel plate approximately ¼ inch thick. The plate 84 is generally rectangular and includes a body portion 100 and a generally L-shaped leg 102 which together define a downwardly opening cut-out 104. A plurality of 7/16-inch apertures or holes 106 extend through the plate body 100 enabling ⅜-inch bolts 108 to be inserted therethrough and the stringer 86 to support the plate on the frame 20. When the plate 84 is secured against the recessed face 94, the exposed surface of the plate is generally coplanar with the outer surface of the stringer 86; and the centerline of the arch 104 is aligned with the end edge 83 of the ramp surface 84. The downwardly opening cut-out 104 is generally arch-shaped having linear sides and a semicircular upper edge. The dimameter of the semicircular edge is slightly larger than the outer diameter of the flange 64 on the slide fitting 52 to fit closely thereabout.

The connector section 110 (FIGS. 1–2 and 10–11) interconnects two ramp sections 14 at the turn 34 (FIG. 2) of the ramp path. The connector unit 110 includes a frame 112 and a ramp surface 114 supported thereon. The frame 112 includes a pair of stringers 116 interconnected by preferably three crossbraces 118. The ramp body 114 is secured on top of the frame 112 using nails or other conventional fasteners. The dimensions of the ramp body 114 are two-feet-by-four feet. Each of the four corners 120 of the connector unit are notched to interfit with the legs 18 of the adjacent support stands 16. A plurality of throughbores or bolt holes 122 are provided in the stringers 116 enabling bolts (not shown) to pass through the stringers 122 and the adjacent stringers 86 of the ramp sections 14 to secure the support unit in place. The connecting unit 110 does not hook onto the frame assembly 12, but is bolted directly to the adjacent ramp sections.

ASSEMBLY

The modular ramp 10 is sold or otherwise distributed in kit form. Depending upon the rise and dimensional constraints, the manfuacturer or distributor will provide the customer with a kit including the components required to erect an appropriate ramp. Although a U-shaped ramp is illustrated in FIGS. 1 and 2, it is envisioned that other ramp configurations can be assembled using the described components.

Typically beginning at the highest end 32 of the ramp 10, the installer will erect the first two leg or support assemblies 16. If the ramp is installed on a hard surface such as concrete, the feet 44 rest on top of the concrete. If the ramp is installed on soil or other soft surface, the feet 44 are forced into the ground to the full extent of their height to provide an appropriate nonshiftable base for the ramp. The leg assemblies 16 are installed on four-foot centers to receive the four-foot-by-four-foot ramp sections 14. The crossbars 20 of the first two leg assemblies are adjusted to be ¾ inch below the height of the porch 38. Consequently, the ramp surface 84 of the first ramp section 14 will be level with the porch. After the crossbars have been adjusted and locked or bolted in position, the ramp section 14 is intalled by hooking the pairs of brackets 84 on either end of the ramp section over the appropriate crossbar 20.

The installer thereafter sequentially erects a leg assembly and installs a ramp section 14. Present government regulations call for a rise of no greater than 1:12. Therefore, the opposite ends of each ramp section 14 can be no greater than 4 inches different in height. Each crossbar 20 is appropriately adjusted and bolted in position; and each ramp section 14 is installed after the crossbar has been so adjusted. The end edges 83 of adjacent ramp sections 14 abut one another over the associated crossbar 20.

At the transition point or curve 34 (FIG. 2), the transition unit 110 is bolted between the two adjacent ramp sections 14.

The last section 14 at the lower end 30 is installed to meet and be level with the sidewalk 36. As illustrated in FIG. 1, this lowermost section can be recessed into the ground. Alternatively, the stringers 86 on this section can be cut diagonally to lay directly on the ground. If the stringers are so cut, the brackets from the lowermost end are eliminated.

After all ramp sections 14 have been installed as described, the handrail sections 23 are installed on the upper ends of each leg 18. The hand rail sections are installed on each side of the ramp path. The slide fitting 52 on either end of each handrail section 21 is adjusted to be a uniform height, preferably 30 to 34 inches, above the associated ramp section 14; and bolts are used to secure the handrail slide fittings 52' in position. Preferably, an intermediate guardrail (not illustrated) is installed between the handrail and the ramp surface for safety and curbing. If so included, the construction of the guardrail is preferably identical to that of the handrail. After all handrail sections 23 are installed, the top caps 46 are placed on the upper end of each leg 18. Preferably, the top caps 46 are not adhered in position to facilitate subsequent disassembly of the ramp 10.

The present ramp is also suitable for use in other installations, such as marinas, wherever people are required or desire to transition between areas of different heights or levels.

The present invention provides a ramp 10 which is easily assembled without any resultant waste. The modular components facilitate manufacture and also ease the assembly of the appropriate kit for a particular installation. Although the construction is relatively simple, the resultant ramp 10 is extremely strong and serviceable. Further, the ramp 10 can be readily disassembled when no longer needed and reinstalled at another dwelling or recombined with other ramp components to produce a ramp kit for a different installation.

The above description is that of a preferred embodiment of the invention. Various alterations and changes may be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A modular ramp kit to be used in erecting a reusable ramp, said kit comprising:

a support framework having components including a plurality of first PVC conventional plumbing pipe segments, a plurality of second PVC conventional plumbing pipe segments having opposite ends, a plurality of conventional plumbing PVC T connectors each including a first hollow portion and a second hollow portion extending orthogonally outward from a medial section of said first hollow portion, and a plurality of locking devices;

said components being cooperatively assembled such that said first PVC pipe segments define a plurality of vertical legs grouped into pairs and arranged to define a path, each said second PVC pipe segment is coupled with a pair of said PVC T connectors to define a plurality of crossbars, each end of said second PVC pipe segments being secured within said second hollow portion of one of said PVC T connectors, one of said crossbars being slidably mounted on each of said grouped legs such that each said leg slidably receives thereon on of said PVC T connectors such that said leg is received into said first hollow portion, each of said PVC T connectors being positioned at a desired elevation along said length of said received leg and secured thereto by said locking devices; and a plurality of ramp sections each including a ramp surface having a pair of opposite ends, each ramp section further including support means for receiving one of said crossbars and for supporting the associated ramp section end on the crossbar, whereby a ramp can be erected by arranging said grouped legs into a path, adjusting the crossbars thereon to have increasing heights along the path, and placing the ramp sections on the support assemblies by interfitting each ramp end support means onto one of said crossbars.

2. A modular ramp kit as defined in claim 1 wherein each of said ramp sections includes:

a wood frame; and a pair of brackets extending from said wood frame at each of said ramp section ends, each of said brackets defining a downwardly opening notch for receiving one of said crossbars.

3. A modular ramp kit as defined in claim 2 wherein each bracket is planar and oriented perpendicularly to said ramp surface, whereby brackets on adjacet ramp sections can interfit to be received on a common crossbar.

4. A modular ramp kit as defined in claim 1 in which said first PVC pipe segments defining said legs further include a series of openings provided longitudinally therealong, and said PVC T connectors further include at least one lateral hole in said first hollow portion, wherein each said PVC T connector is secured at said desired elevation on said received leg by aligning said lateral hole with one of said series of openings and passing one of said locking devices through said aligned hole and opening.

5. A modular ramp kit as defined in claim 1 further comprising a handrail assembly formed of components including a plurality of third PVC conventional plumbing pipe segments, certain of said plurality of conventional plumbing PVC T connectors and certain of said locking devices, said handrail components being assembled into said handrail assembly such that a first handrail PVC T connector is received over each vertical leg such that each leg is received through said first hollow portion thereof, said first handrail PVC T connector being secured to said received leg at a desired elevation above said PVC T connector forming said crossbar by said locking devices, a second handrail PVC T connector being secured to said first handrail PVC T connector such that said second hollow portions are longitudinally aligned and secured to one another in such a manner that said first hollow portion of said second handrail PVC T connector is substantially orthogonally oriented relative to said second PVC pipe segment forming said crossbar, and said third PVC pipe segments defining handrail segments being received into said second hollow portions of said second handrail PVC T connectors to thereby define a handrail assembly which follows said path.

6. A modular ramp kit as defined in claim 5 in which said first PVC pipe segments defining said legs further include a series of openings provided longitudinally therealong, and said PVC T connectors further include at least one lateral hole in said first hollow portion, wherein said PVC T connectors forming said crossbar and said first handrail PVC T connectors are each secured to said received leg by aligning said lateral hole with one of said series of openings and passing one of said locking devices through said aligned hole and opening.

7. A modular ramp kit as defined in claim 6 further including a stub pipe which is received into said second hollow portion of each of said handrail PVC T connectors to thereby secure said handrail PVC T connectors together.

8. A modular ramp kit as defined in claim 7 further including a plurality of conventional plumbing PVC bell reducers secured to one end of said first PVC pipe segments to define a foot therefor of increased lateral dimension.

9. A modular ramp kit as defined in claim 1 further including a plurality of conventional plumbing PVC bell reducers secured to one end of said first PVC pipe segments to define a foot therefor of increased lateral dimension.

10. A modular ramp for providing building access for physically handicapped and wheelchair-bound individuals comprising:

a plurality of vertical upright members arranged in pairs and oriented to define a path having a first and second sides and at least one turn;

a horizontal support member extending between each pair of vertical upright members, said horizontal support member including a pair of slide fittings each slidably received on one of said vertical upright members to be vertically slidable therealong;

interlock means for interlocking each slide fitting and the associated vertical support member at any one of a plurality of heights;

a plurality of generally planar ramp sections each including a ramp surface having a pair of opposite ends, a pair of opposite sides interconnecting said opposite ends and support means for supporting the ramp section between two of the horizontal support members, said support means including a plurality of brackets projecting outwardy from said ramp surfaces such that at least one of said brackets extends from each of said opposite ends, said brackets each being provided with a cutout to receive therein one of said horizontal support members, certain of said horizontal support members being positioned at different elevations so that certain of said ramp sections are oriented at an inclination to the horizontal, and said cutouts on said brackets being configured to have a predetermined depth to thereby receive therein substantially an entire cross sectional portion of said horizontal support member so that said ramp sections can be securely mounted and maintained on said horizontal support members in said inclined orientations whereby said ramp sections can be arranged on said horizontal support members with said ramp surfaces aligned to provide a substantially continuous surface which may be traveled to gain access into a building; and a connecting section having a generally planar upper surface, a pair of opposite edges, and means for attaching said opposite edges to said sides of a pair of spaced apart horizontal ramp sections to thereby define said at least one turn in said path, whereby said upper surface of said connecting section cooperates with said ramp surfaces to form a substantially continuous surface.

11. A modular ramp as defined in claim 10 further including a plurality of handrail segments each having a pair of slide fittings each slidably received on one of said vertical upright members, and rail interlock means for interlocking each rail slide fitting and the associated vertical upright member at any one of a plurality of heights.

12. A modular wheelchair ramp as defined in claim 11 wherein all of said vertical upright members, said horizontal support members, and said rail segments are fabricated of conventional PVC plumbing components.

13. A modular ramp for providing building access for physically handicaped and wheelchair-bound individuals comprising:

a plurality of vertical upright members arrangned in pair and oriented to define a path having first and second sides and at least one turn;

a horizontal support member extending between each pair of vertical upright members, said horizontal support member including a pair of slide fittings each slidably received on one of said vertical upright members to be vertically slidable therealong;

interlocking means for interlocking each slide fitting and the associated vertical support member at any one of a plurality of heights;

a plurality of generally planar ramp sections each including a ramp surface having a pair of opposite ends, a pair of opposite sides interconnecting said opposite ends and support means for supporting the ramp section between two of the horizontal support members, said support means including a plurality of brackets projecting outwardly from said ramp surfaces such that at least one of said brackets extends from each of said opposite ends, said brackets each being provided with a cutout to receive therein one of said horizontal support members; and a connecting section having a generally planar upper surface, a pair of opposite edges, and means for attaching said opposite edges to said sides of a pair of spaced apart horizontal ramp sections to thereby define said at least one turn in said path, whereby said upper surface of said connecting section cooperates with said ramp surfaces to form a substantially continuous surface.

14. A modular wheelchair ramp as defined in claim 13 wherein said interlock means includes:

said vertical upright members each defining a plurality of apertures along its height;

said slide fitting each defining an aperture alignable with said upright member apertures; and fastener means for extending through aligned apertures on said upright members and said slide fittings.

15. A modular wheelchair ramp as defined in claim 13 wherein each ramp section further includes a retaining lip extending upwardly from said ramp surface on the opposite sides of the path to assist in retaining objects on said ramp surface.

16. A modular ramp as defined in claim 13 in which certain of said horizontal support members are positioned at different elevations so that certain of said ramp sections are oriented at an inclination to the horizontal, and wherein said cut-outs on said brackets are each configured to have a predetermined depth to thereby receive therein substantially an entire cross-sectional portion of said horizontal support member so that said ramp sections can be securely mounted and maintained on said horizontal support members in said inclined orientations.

17. A modular ramp as defined in claim 13 in which each said end of said ramp section includes a pair of said brackets spaced apart from one another and mounted upon said horizontal support members such that each bracket of one ramp section intermediately positioned along said path is in close juxtaposition with one of said brackets of an adjacent ramp section.

18. A modular ramp as defined in claim 13 in which said plurality of brackets extending from said opposite ends of said ramp surfaces are substantially similar in shape.

19. A modular ramp construction comprising:

a plurality of leg assemblies, a plurality of ramp sections and at least one connecting section;

said plurality of leg assemblies being sequentially arranged to define a path and having the capacity to define said path as a linear path and the capacity to define said path with at least one turn, each like assembly including a pair of generally vertical legs and a generally horizontal crossbar extending therebetween, said crossbar including slide means for slidably supporting said crossbar on each of said legs and lock means for locking said slide means at a desired location along the length of said legs such that said certain of said cross-bars are positioned at different elevations so as to position certain of said ramp sections at an inclination to the horizontal;

said plurality of ramp sections being sequentially arranged along the path, each ramp section including a planar ramp surface having a pair of opposite ends a pair of opposite sides interconnecting said opposite ends, and each ramp assembly further including support means for supporting each of said opposite ends on one of said leg assembly crossbars to define a generally continuous ramp surface; and said connecting section having a generally planar upper surface, a pair of opposite edges, and means for attaching said opposite edges to said sides of a pair of spaced apart horizontal ramp sections to thereby define a turn in said path, whereby said upper surface of said connecting section cooperates wtih said ramp surfaces to form a substantially continuous surface.

20. A modular ramp construction as defined in claim 19 wherein said leg assemblies are fabricated substantially exclusively of PVC plumbing components.

21. A modular ramp construction as defined in claim 19 further comprising a plurality of handrail segments extending between legs of different leg assemblies to provide a handrail for said ramp construction.

22. A modular ramp construction as defined in claim 21 wherein said leg assemblies and said rail segments are fabicated substantially exclusively of PVC plumbing components.

23. A modular ramp construction as defined in claim 21 wherein each of said rail segments includes:

slide means for slidably supporting the rail segment on the associated legs; and lock means for locking said slide means at a desired location along the length of the associated legs.

24. A modular ramp construction as defined in claim 19 in which said support means includes a plurality of brackets which extend from each of said opposite sides of said ramp surface, wherein each said bracket is formed as a generally planar member having a notch, said notch being of a sufficient depth to receive therein substantially the entire width of one of said crossbars.

* * * * *

UNITED STATES PATENT AND TRADEMARK OFFICE

CERTIFICATE OF CORRECTION

PATENT NO. : 4,807,317

DATED : February 28, 1989

INVENTOR(S) : Charles F. Quinn et al

It is certified that error appears in the above-identified patent and that said Letters Patent is hereby corrected as shown below:

Column 6, Claim 1, Line 6:
"on" should be --one--.

Column 7, Claim 10, Line 31:
Delete second occurrence of "a".

Signed and Sealed this

Seventh Day of November, 1989

*Attest:*

JEFFREY M. SAMUELS

*Attesting Officer*

*Acting Commissioner of Patents and Trademarks*